US011650002B2

(12) United States Patent
Lim et al.

(10) Patent No.: US 11,650,002 B2
(45) Date of Patent: May 16, 2023

(54) REFRIGERATOR

(71) Applicant: LG Electronics Inc., Seoul (KR)

(72) Inventors: Hyunae Lim, Seoul (KR); Jinhan Lim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/400,636

(22) Filed: Aug. 12, 2021

(65) Prior Publication Data

US 2022/0049892 A1 Feb. 17, 2022

(30) Foreign Application Priority Data

Aug. 12, 2020 (KR) ..... 10-2020-0101419

(51) Int. Cl.
*F25D 23/02* (2006.01)

(52) U.S. Cl.
CPC ..... *F25D 23/028* (2013.01); *F25D 2323/021* (2013.01); *F25D 2323/022* (2013.01); *F25D 2323/024* (2013.01)

(58) Field of Classification Search
CPC ..... F25D 23/028; F25D 2323/021; F25D 2323/022; F25D 2323/024; F25D 11/02; F25D 23/087; F25D 2323/0011; F25D 23/02; E05F 5/02; E05F 5/06; A47B 88/477; A47B 95/043; A47B 2210/0018; E05Y 2600/33; E05Y 2201/224; E05Y 2600/12
See application file for complete search history.

(56) References Cited

U.S. PATENT DOCUMENTS 1,226,442 A * 5/1917 Atwood ..... E05F 5/06 16/86 A
3,026,825 A * 3/1962 Kidwell ..... F25D 29/006 109/63.5
5,248,174 A * 9/1993 Matz ..... E05B 65/0852 292/DIG. 47
5,575,116 A * 11/1996 Carlson ..... E05C 19/06 49/449

(Continued)

FOREIGN PATENT DOCUMENTS

| | | |
|---|---|---|
| EP | 3926270 | 12/2021 |
| KR | 101651139 | 8/2016 |
| KR | 20190066721 | 6/2019 |

OTHER PUBLICATIONS

English translation of KR20190066721 (Year: 2019).*
Extended European Search Report in European Appln. No. 21190801.7, dated Feb. 8, 2022, 11 pages.

*Primary Examiner* — Hiwot E Tefera
(74) *Attorney, Agent, or Firm* — Fish & Richardson P.C.

(57) ABSTRACT

A refrigerator includes: a cabinet defining a storage space, a door configured to open and close the storage space, and a step difference adjustment member disposed at a rear surface of the door. The step difference adjustment member comprises (i) a stopper that contacts, based on the door being closed, a front surface of the cabinet and (ii) a mounting portion that defines an accommodation space into which the stopper is inserted, and the stopper is configured to move with respect to the mounting portion to thereby vary a protruding length of the stopper from the mounting portion.

19 Claims, 9 Drawing Sheets

(56) References Cited

U.S. PATENT DOCUMENTS

| | | | | |
|---|---|---|---|---|
| 2008/0074019 | A1* | 3/2008 | Park | A47B 88/956 312/348.4 |
| 2008/0120912 | A1* | 5/2008 | Crompton | F25D 23/028 49/372 |
| 2008/0265729 | A1* | 10/2008 | Netzer | A47B 88/40 312/330.1 |
| 2010/0219648 | A1* | 9/2010 | Watson | E05F 7/04 292/343 |
| 2012/0032572 | A1 | 2/2012 | Lee | |
| 2012/0280608 | A1 | 11/2012 | Park et al. | |
| 2015/0026923 | A1* | 1/2015 | Nakasone | F16F 1/128 16/85 |
| 2018/0172337 | A1* | 6/2018 | Choi | A47F 3/043 |
| 2021/0396448 | A1* | 12/2021 | Bae | F25D 11/02 |

* cited by examiner

REFRIGERATOR

CROSS-REFERENCE TO RELATED APPLICATIONS

This application claims priority under 35 U.S.C. § 119 to Korean Patent Application No. 10-2020-0101419, filed on Aug. 12, 2020. The disclosure of the prior application is incorporated by reference in its entirety.

BACKGROUND

The present disclosure relates to a refrigerator.

In general, refrigerators are home appliances for storing foods at a low temperature in an internal storage space that is shielded by a door. To this end, the refrigerator is configured such that foods are stored in an optimal state, by cooling the inside of the storage space using cold air generated through heat exchange with refrigerant circulating in a refrigeration cycle.

The storage space of the refrigerator may be opened and closed by the door. In addition, the refrigerator may be classified into various types of refrigerators according to the arrangement shape of the storage space and the structure of a door for opening and closing the storage space.

On the other hand, doors disposed on the left and right or doors disposed on the upper and lower sides have different degrees of protrusions back and forth, thereby causing a front-and-rear step difference.

This may cause minute distortion of a door according to a refrigerator manufacturing process and assembly tolerance of a cabinet and a door.

Accordingly, it may lead to a defect in appearance of products according to the front-and-rear step difference of the door and may impair the sense of beauty of the overall appearance of the refrigerator.

Korean Patent Publication No. 10-1651139, which is a related art, discloses a refrigerator in which a step difference adjustment member includes a rotation body and a stopper protruding from an outer circumferential surface of the rotation body.

In the related art, at least three or more parts are required, and, when a step difference between the refrigerator doors occurs during use, a consumer has to purchase a new stopper and repair it.

Therefore, since it is not possible to immediately adjust the front-and-rear step difference of the door, it is difficult to cope with the front-and-rear step difference of the door during manufacture of the refrigerator, thereby reducing manufacturability. In addition, it is difficult to cope with the front-and-rear step difference of the door that may occur while the user uses the refrigerator, which may lead to product failure.

SUMMARY

The present disclosure provides a refrigerator capable of adjusting a front-and-rear step difference between doors.

Selectively or additionally, the present embodiment provides a refrigerator capable of ensuring thermal insulation of a door in provision of a step difference adjustment member for adjusting a front-and-rear step difference between doors on the doors.

Selectively or additionally, the present embodiment provides a refrigerator capable of easily adjusting a front-and-rear step difference between doors while the refrigerator is installed and used.

A refrigerator according to an embodiment of the present disclosure may include a step difference adjustment member capable of adjusting a distance between each door and a cabinet such that a step difference does not occur between the plurality of doors.

In particular, the step difference adjustment member is provided on a rear surface of the door to be in contact with the front surface of the cabinet when the door is closed, thereby mitigating shock and preventing noise from being generated when the door is closed.

A refrigerator according to an embodiment of the present disclosure may include a cabinet provided with a storage space, a door configured to open and close the storage space, and a step difference adjustment member provided on a rear surface of the door. The step difference adjustment member may include a stopper in contact with a front surface of the cabinet when the door is closed, and a mounting portion provided with an accommodation space, into which the stopper is inserted.

A protruding length of the stopper from the mounting portion may be adjusted through sliding movement of the stopper.

The mounting portion may include an opening opened toward the rear surface of the door, and the accommodation space in which the stopper inserted may be recessed from the opening.

The mounting portion may have different depths recessed from the opening in left and right directions.

The mounting portion may include an inclined portion forming the accommodation space and inclined with respect to the opening.

The mounting portion may include a pair of parallel side surfaces, and a length of one side surface may be greater than that of the other side surface.

The mounting portion may include protrusion ends protruding from the pair of side surfaces toward each other.

The stopper may slide between the protrusion ends to adjust a length of a portion of the stopper protruding from the rear surface of the door.

The mounting portion may include a seating surface on which the stopper is seated, and a plurality of projections protruding from the seating surface.

The stopper may be located and fixed between two adjacent projections among the plurality of projections.

The stopper may include a stopper body including irregularities in a surface in contact with the cabinet and recessed portions recessed inward from both side surfaces of the stopper body.

The recessed portions may be located between two adjacent projections among the plurality of projections, and a height of a protrusion of the plurality of projections may be less than that of the stopper body.

Distances from the rear surface of the door to the plurality of projections may be different.

The mounting portion may protrude backward from the rear surface of the door, and the stopper may be formed of an elastically deformable material.

DETAILED DESCRIPTION OF THE EMBODIMENTS

Figure 1:
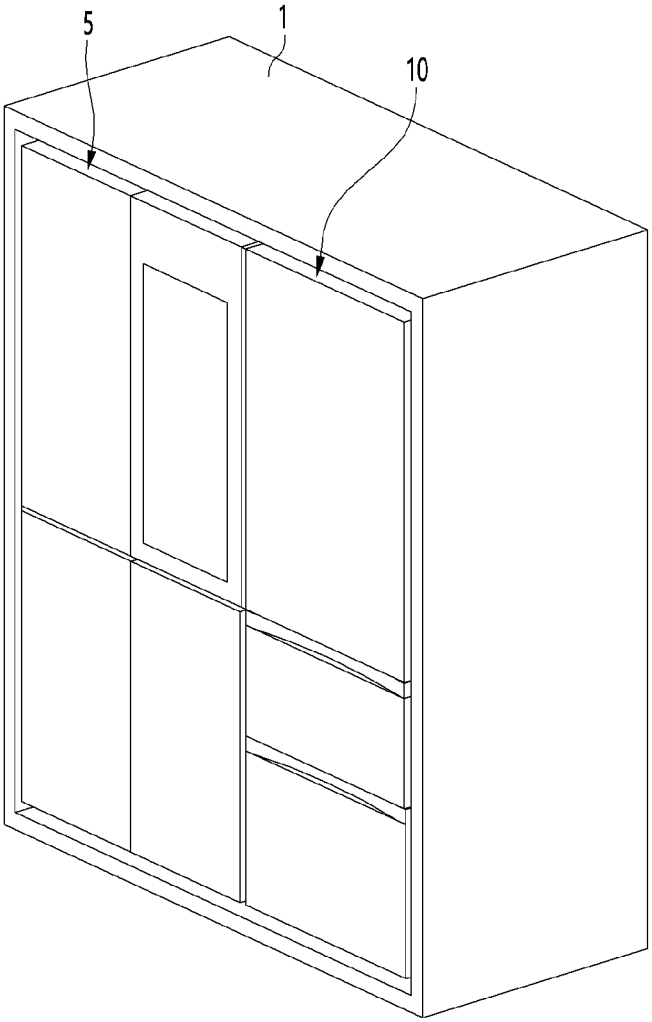
FIG. 1 is a view showing a state in which a refrigerator according to an embodiment of the present disclosure is installed in a furniture cabinet.
Figure 2:
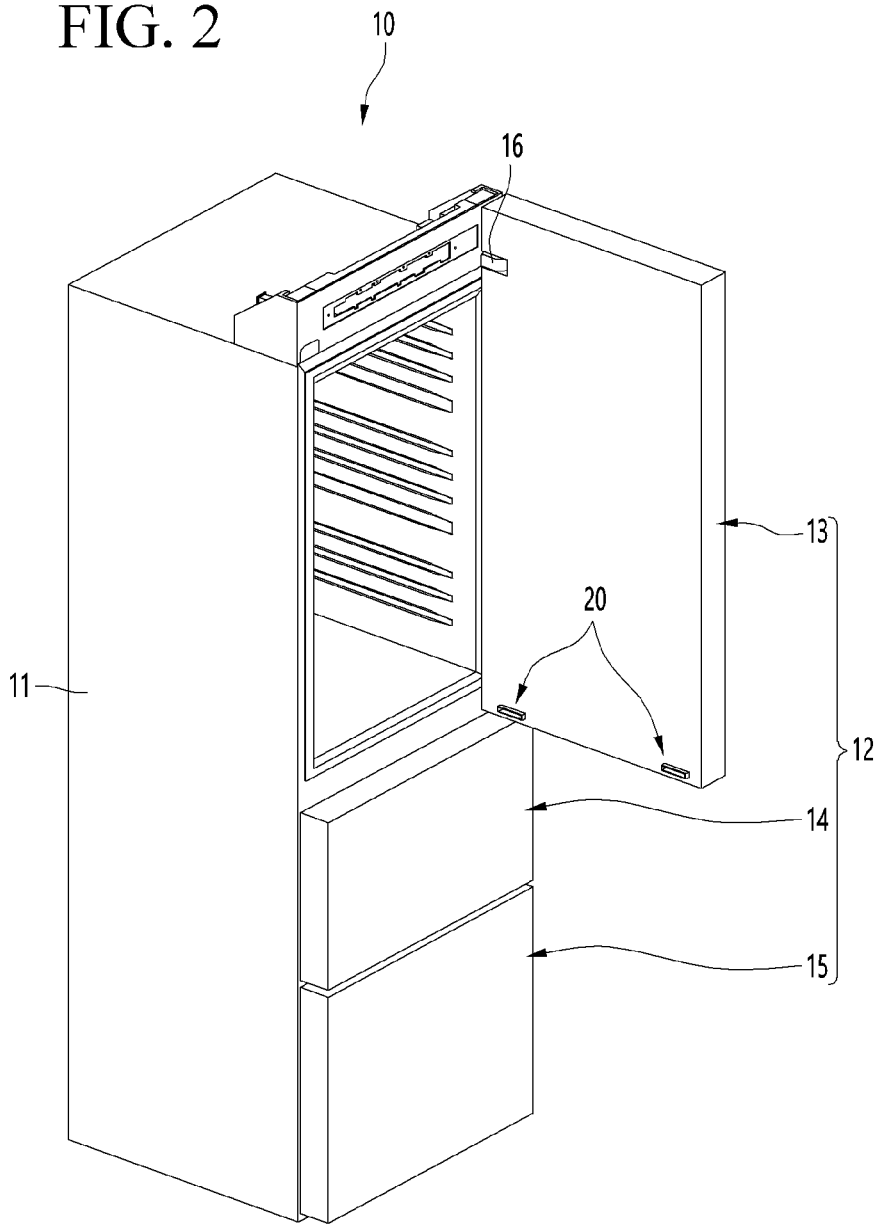
FIG. 2 is a perspective view of a refrigerator according to an embodiment of the present disclosure.
Figure 3:
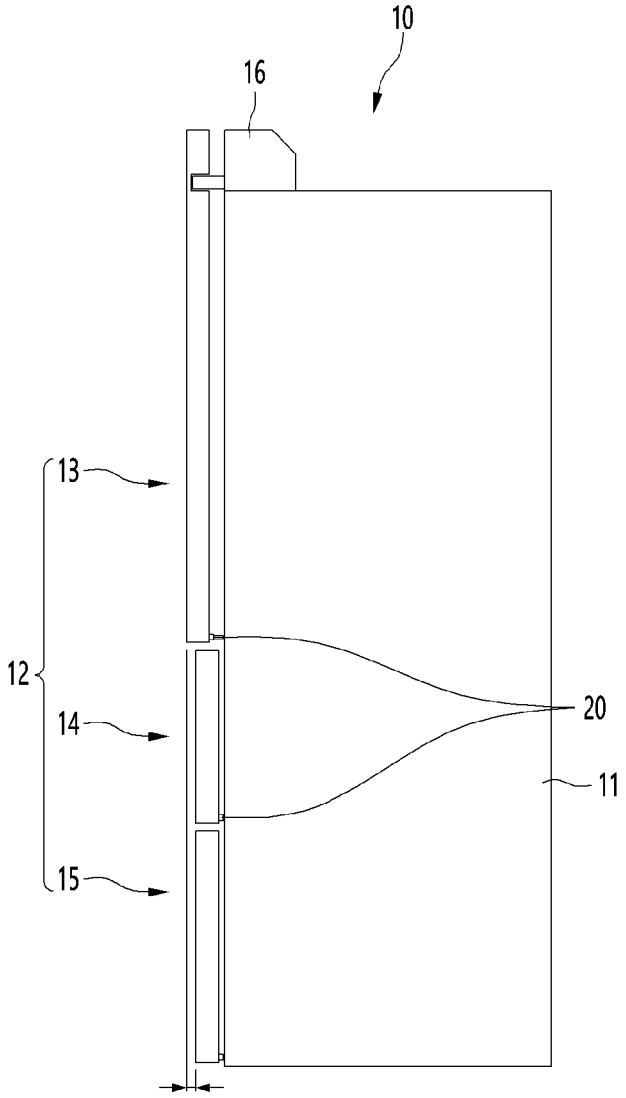
FIG. 3 is a side view of a refrigerator according to an embodiment of the present disclosure.

FIG. 1 is a view showing a state in which a refrigerator according to an embodiment of the present disclosure is installed in a furniture cabinet, FIG. 2 is a perspective view of a refrigerator according to an embodiment of the present disclosure, and FIG. 3 is a side view of a refrigerator according to an embodiment of the present disclosure.

Referring to FIGS. 1 to 3, the refrigerator 10 according to the present embodiment may be placed in a kitchen or living room independently or together with another refrigerator 5.

A furniture cabinet 1 in which the refrigerators 5 and 10 are accommodated may be provided in the kitchen or living room. The height of the internal accommodation space of the furniture cabinet 1 may be set such that a gap between the upper surfaces of the refrigerators 5 and 10 and the upper wall of the furniture cabinet 1 is not large in a state in which the refrigerators 5 and 10 are accommodated.

When the gap between the upper surfaces of the refrigerators 5 and 10 and the upper wall of the furniture cabinet 1 is not large, the upper structures of the refrigerators 5 and 10 are not visible from the outside and the sense of unity of the furniture cabinet 1 and the refrigerators 5 and 10 may increase.

The refrigerator 10 may include a cabinet 11 including a storage compartment and a refrigerator door 12 for opening and closing the storage compartment.

A plurality of doors 12 may be provided and the number of doors may be correspond to the number of storage compartments. In addition, one door may be provided to open and close one storage compartment.

The door 12 may include a plurality of doors 13, 14 and 15 spaced apart from each other in a vertical direction. Some or all of the plurality of doors 13, 14 and 15 may open and close the storage compartment in a sliding or rotation manner.

Specifically, the door 12 may include a first door 13 for opening and closing an upper storage compartment, a second door 14 for opening and closing a middle storage compartment and a third door 15 for opening and closing a lower storage compartment.

For example, the first door 13 may open and close the storage compartment in a rotation manner, and the second door 14 and the third door 15 may open and close the storage compartment in a sliding manner.

The door 12 may include a frame assembly 100 defining appearance and a door liner 150 coupled to the frame assembly 100 to define a rear surface of the refrigerator door 12.

Meanwhile, a thermal insulation material (not shown) may be filled in a space formed by the frame assembly 100 and the door liner 150.

In addition, the door 12 may be rotatably coupled to the cabinet 11 by a hinge device 16, and may be provided to open and close the storage compartment by rotation.

The hinge device 16 rotatably connecting the door 12 to the cabinet 11 may be coupled to the frame assembly 100. One side of the hinge device 16 may be coupled to the upper surface of the frame assembly 100.

The frame assembly 100 may support the overall load of the door. For stable load support of the frame assembly 100, the frame assembly 100 may be provided to have higher strength than the door liner 26.

On the other hand, due to a difference between the magnetic force of a gasket and dispersion according to the manufacturing process of the refrigerator, a front-and-rear step difference may occur between a left door and a right door or an upper door and a lower door in a state in which the doors are closed. For example, a front-and-rear step difference may occur between the first door 13, the second door 14 and the third door 15 disposed vertically.

Such a front-and-rear step difference may make the front surface of the refrigerator 1 appear to be distorted, greatly impairing external aesthetics.

In order to prevent such a problem, the door 12 is provided with a step difference adjustment member 20 for adjusting the front-and-rear step difference.

The step difference adjustment member 20 may be provided on at least one of doors disposed horizontally, at least one of doors disposed vertically or all doors.

The step difference adjustment member 20 may be provided on the rear surface of the door 12, and a plurality of step difference adjustment members may be provided on one door. For example, the step difference adjustment member 20 may be provided the lower side of the rear surface of the door 12.

Hereinafter, the step difference adjustment member 20 will be described in detail.

Figure 4:
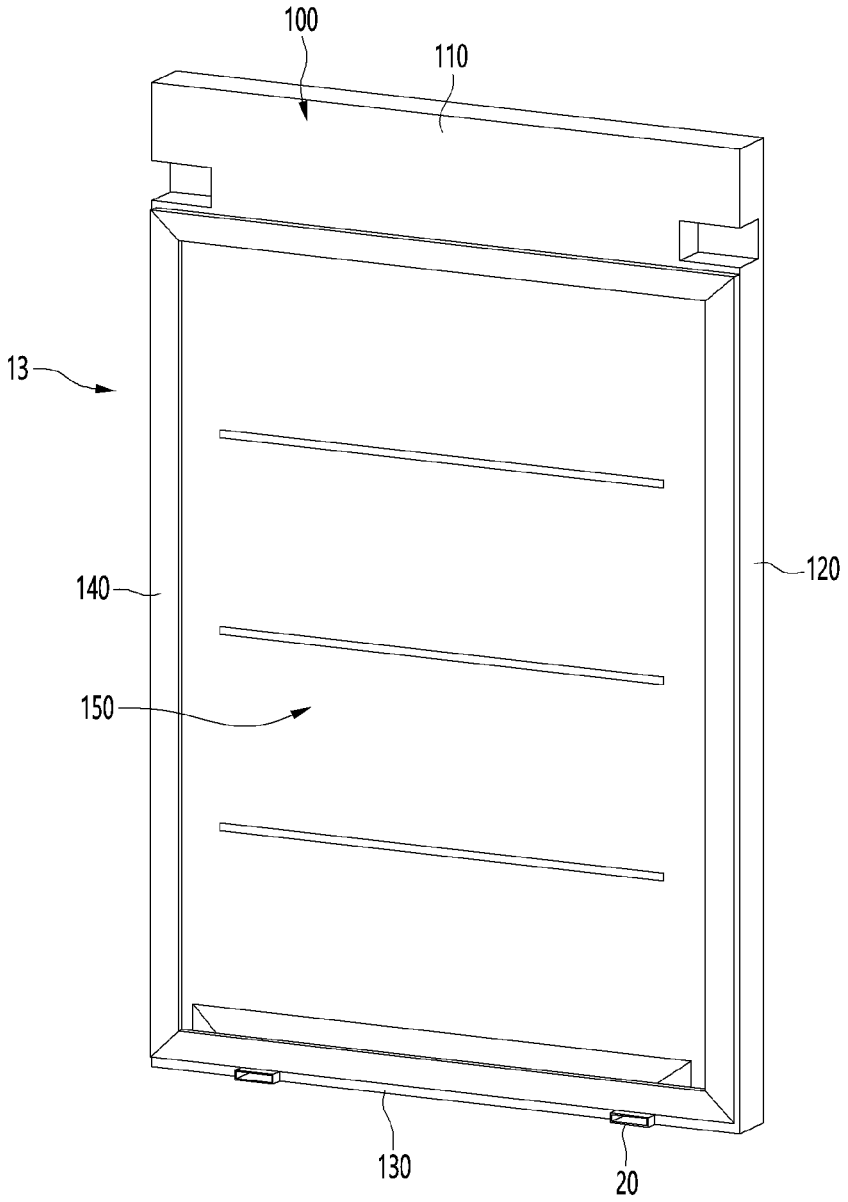
FIG. 4 is a perspective view of a refrigerator door according to an embodiment of the present disclosure.
Figure 5:
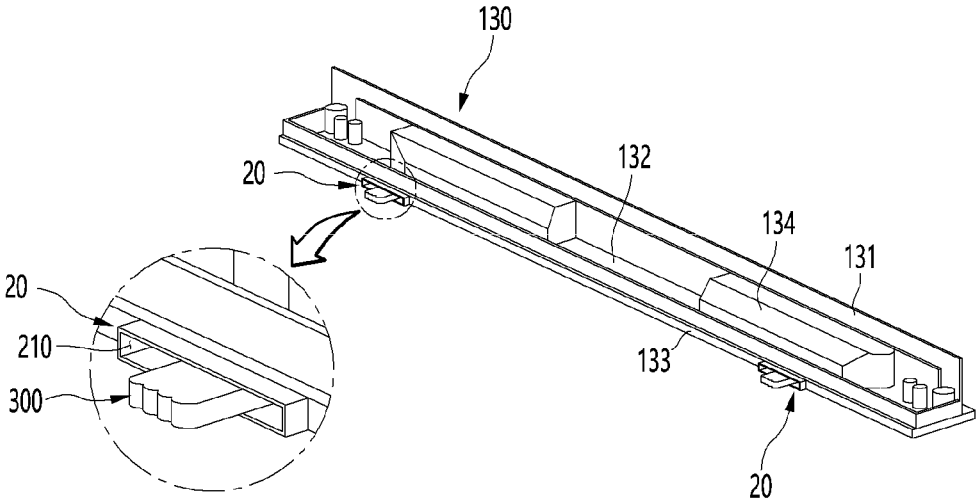
FIG. 5 is a perspective view of a lower frame according to an embodiment of the present disclosure.
Figure 6:
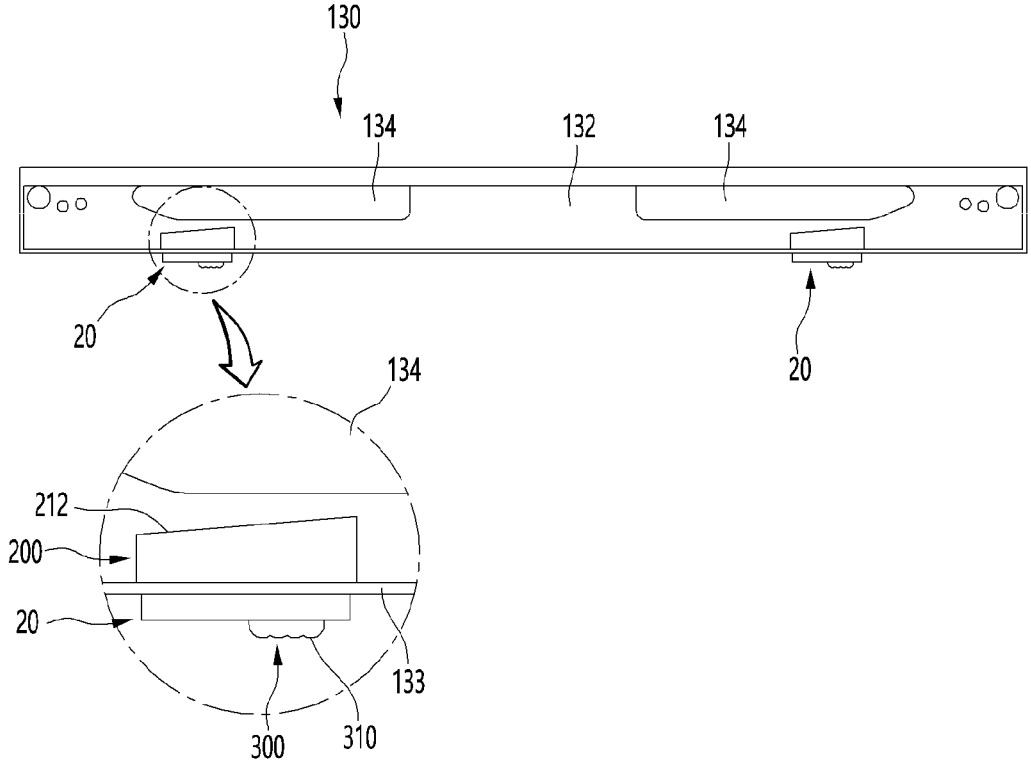
FIG. 6 is a plan view of a lower frame according to an embodiment of the present disclosure.
Figure 7:
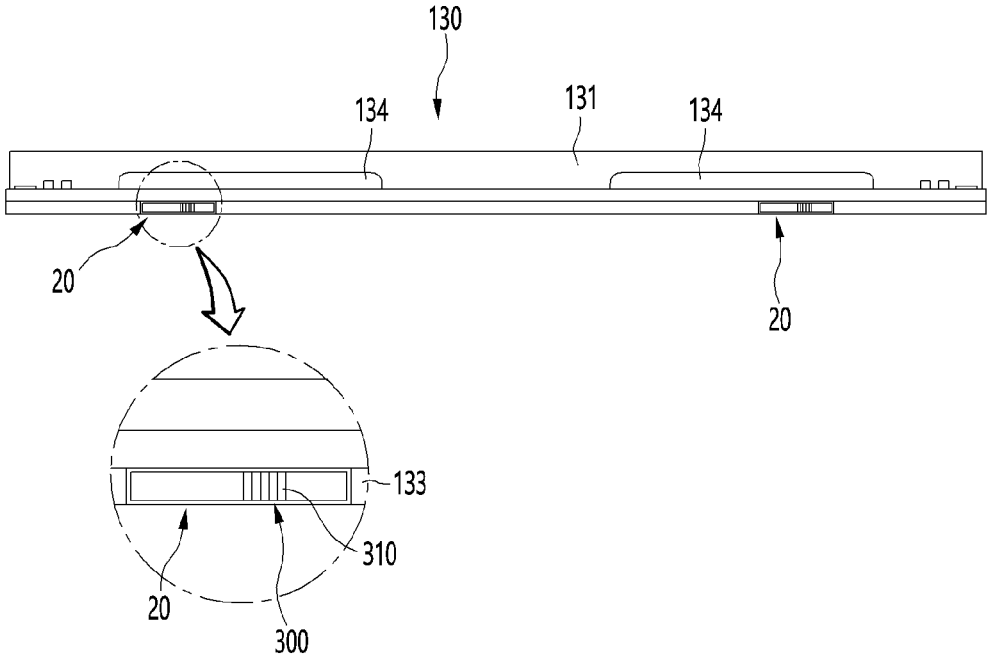
FIG. 7 is a rear view of a lower frame according to an embodiment of the present disclosure.

FIG. 4 is a perspective view of a refrigerator door according to an embodiment of the present disclosure, FIG. 5 is a perspective view of a lower frame according to an embodiment of the present disclosure, FIG. 6 is a plan view of a lower frame according to an embodiment of the present disclosure, and FIG. 7 is a rear view of a lower frame according to an embodiment of the present disclosure.

Referring to FIG. 4, the door 12 may include the frame assembly 100 defining an external surface, a door liner 150 defining the rear surface of the frame assembly 100, and a gasket 140 sealing between the frame assembly 100 and the door liner 150.

Specifically, the frame assembly 100 may include an upper frame 110 defining an upper surface, a lower frame 130 defining a lower surface and a side frame 120 connecting the upper frame 110 with the lower frame 130.

The lower frame 130 may be provided with a step difference adjustment member 20 for adjusting a step difference between the door 12 and the cabinet 11.

Since the plurality of doors 12 is included, a difference may occur in the front-and-rear step difference between each door 12 and the cabinet 11.

Specifically, referring to FIG. 3, a step difference may occur between the first door 13, the second door 14 and the third door 15 disposed vertically, impairing the aesthetics of the external appearance and providing inconvenience to users.

Therefore, the doors 12 are respectively provided with the step difference adjustment members 20 such that the front surfaces of the doors 12 are located on the same plane.

Meanwhile, the step difference adjustment member 20 of the present disclosure may be disposed on the lower side of the door 12.

Specifically, the step difference adjustment member 20 may be provided on the lower frame 130.

Referring to FIGS. 5 to 7, the rear surface of the lower frame 130 may be provided with the step difference adjustment member 20.

Specifically, the lower frame 130 may include a vertical frame 131 defining a front surface and coupled to a front panel of the door 12 and a horizontal frame 132 bent from the vertical frame 131 to define a lower surface of the door 12.

In addition, a lower frame rear surface 133 may be formed spaced apart from the vertical frame 131 and may be provided with the step difference adjustment member 20.

In addition, the horizontal frame 132 may be further provided with a handle 134 recessed upward.

For example, a plurality of handles 134 may be provided and the door 12 may be opened and closed by inserting a user's hand into the upwardly recessed portion.

Meanwhile, a plurality of step difference adjustment members 20 may be provided on the lower frame rear surface 133 to be spaced apart from each other, and may protrude from the lower frame rear surface 133.

Figure 8:
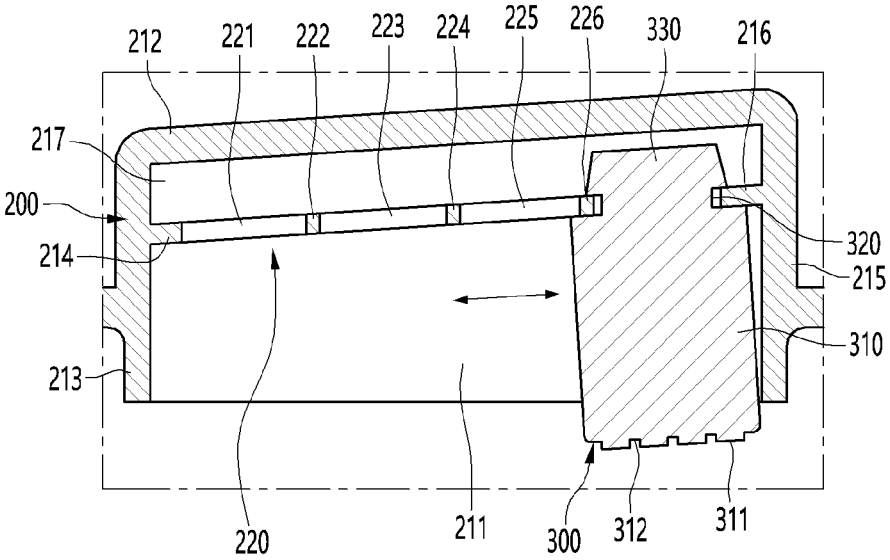
FIG. 8 is a cross-sectional view of a step difference adjustment member according to an embodiment of the present disclosure.
Figure 9:
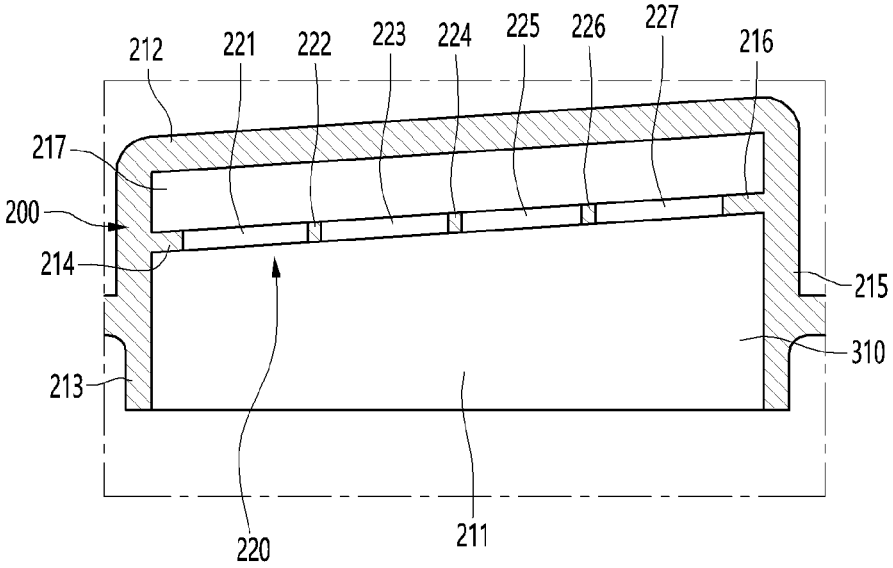
FIG. 9 is a view showing a state in which a stopper is removed from the cross-sectional view of FIG. 8.
Figure 10:
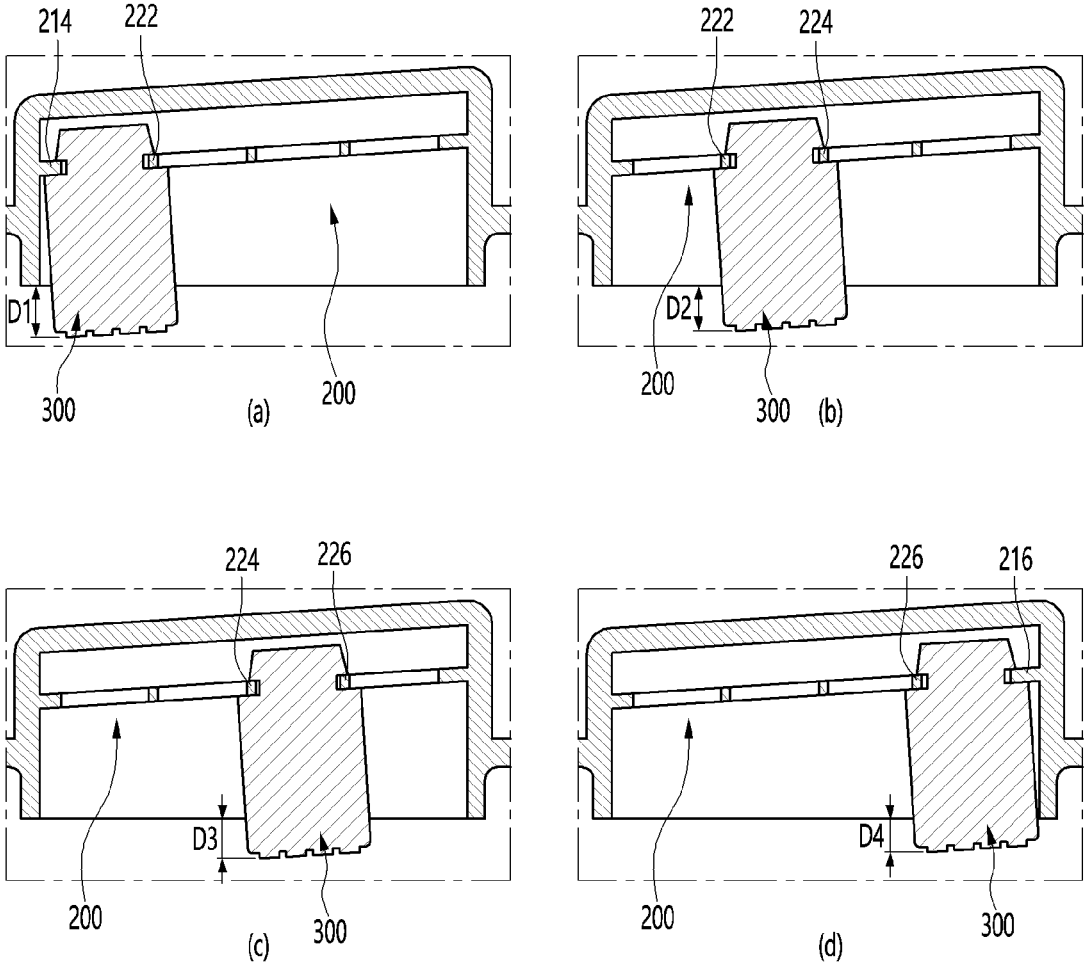
FIG. 10 is a view showing a state in which a step difference adjustment member according to an embodiment of the present disclosure is moved.

FIG. 8 is a cross-sectional view of a step difference adjustment member according to an embodiment of the present disclosure, FIG. 9 is a view showing a state in which a stopper is removed from the cross-sectional view of FIG. 8, and FIG. 10 is a view showing a state in which a step difference adjustment member according to an embodiment of the present disclosure is moved.

Referring to FIGS. 8 to 10, the step difference adjustment member 20 may include a mounting portion 200 formed to protrude toward the rear surface of the lower frame 130 and a stopper 300 inserted into the mounting portion 200.

Specifically, the mounting portion 200 may include an opening 210 through which the stopper 300 is inserted in the rear surface of the lower frame 130.

That is, the mounting portion 200 may include the opening 210 and have an accommodation space into which the stopper 300 is inserted.

Specifically, the mounting portion 200 may include a seating surface 211 in which the stopper 300 is seated in a vertical direction, and include a plurality of side surfaces connecting the seating surface 211.

For example, a first side surface 213 and a second side surface 215 connecting the seating surface 211 at both sides may be included.

In addition, an inclined portion 212 connecting the seating surface 211 at an end of the space, into which the stopper 300 is inserted, may be further included.

For example, the length of the first side surface 213 may be less than that of the second side surface 215.

Specifically, the inclined portion 213 connecting one end of each of the first side surface 213 and the second side surface 215 may include an inclination compared to the rear surface of the lower frame 130.

That is, a horizontal cross-section of an adjustment portion 220 may have a trapezoidal shape in which a pair of side surfaces are parallel and another pair of side surfaces are not parallel.

In addition, the adjustment portion 220 parallel to the inclined portion 212 and spaced apart from the inside of the seating surface 211 may be further included.

A long cavity portion 217 may be formed between the inclined portion 212 and the adjustment portion 220 to form an open space.

For example, the long cavity portion 217 may be a component, into which a fixing portion 330 of the stopper 300 is inserted and fixed.

Meanwhile, the adjustment portion 220 may connect a first protrusion end 214 of the first side surface 213 and a second protrusion end 216 of the second side surface 215.

In addition, the adjustment portion 220 may include a plurality of projections and a plurality of position surfaces on which the stopper 300 is seated.

Specifically, the stopper 300 may include a recessed portion 320 for preventing left and right movement, and the recessed portion 320 is seated on the adjustment portion 220 to adjust a step difference between the door 12 and the cabinet 11.

That is, the stopper 300 is seated on the plurality of position surfaces to adjust the step difference between the door 12 and the cabinet 11 through a degree of protrusion of the stopper 300 according to the plurality of position surfaces.

For example, the adjustment portion 220 may include a first projection 222, a second projection 224 and a third projection 226 spaced apart from each other and include a first position 221 formed between the first protrusion end 214 and the first projection 222, a second position 223 formed between the first projection 222 and the second projection 224, a third position 225 formed between the second projection 224 and the third projection 226, and a fourth position 227 formed between the third projection 226 and the second protrusion end 216.

Specifically, since the length of the first side surface 213 is less than that of the second side surface 215, as the stopper 300 moves from the first position 221 to the fourth position 227, a distance between the door 12 and the cabinet 11 may decrease.

That is, as the stopper 300 moves from the first position 221 to the fourth position 227, the length of a outwardly protruding portion of the stopper 300 may be shortened.

In this case, since the degree of protrusion of the plurality of projections is less than the height of the stopper 300, when a user applies force, movement between positions is possible. However, in general cases, left and right movement may be prevented by the plurality of projections.

Specifically, the length of protrusion of the stopper 300 toward the rear surface of the door 12 when the stopper 300 is positioned at the first position 221 may be a first length D1, the length of protrusion of the stopper 300 toward the rear surface of the door 12 when the stopper 300 is positioned at the second position 223 may be a second length D2, the length of protrusion of the stopper 300 toward the rear surface of the door 12 when the stopper 300 is positioned at the third position 225 may be a third length D3, and the length of protrusion of the stopper 300 toward the rear surface of the door 12 when the stopper 300 is positioned at the fourth position 227 may be a fourth length D4.

In addition, the magnitudes of the first length D1, the second length D2, the third length D3 and the fourth length D4 may decrease in this order.

Meanwhile, the stopper 300 may be formed of an elastic material, for example, rubber.

In addition, the stopper 300 may serve to mitigate collision between the door 12 and the cabinet 11. Accordingly, a plurality of convex portions 311 and a plurality of grooves 312 may be formed in a front surface of the stopper body 310.

That is, as irregularities are formed in the front surface of the stopper body 310 and the stopper is formed of an elastic material, it is possible to mitigate collision between the door 12 and the cabinet 11.

In addition, as the stopper 300 is formed of an elastically deformable material, when the stopper is mounted in the mounting portion 200, the stopper 300 may be easily mounted and detached by applying force thereto.

In addition, when the door 12 is closed, the stopper 300 is elastically deformed when being brought into contact with the front surface of the cabinet 11, thereby absorbing shock and preventing noise from being generated.

In addition, the stopper 300 may include a recessed portion 320 having a size corresponding to a distance between the plurality of projections of the adjustment portion 220.

The left-and-right length of the recessed portion 320 may be less than that of the stopper body 310, thereby preventing the stopper 300 from moving in the front and rear direction.

In addition, the stopper 300 may further include a fixing portion 330 provided in the opposite direction of the stopper body 310 with respect to the recessed portion 320, and the left-and-right length of the fixing portion 330 may also be greater than that of the recessed portion 320.

That is, the stopper 300 may be located on the adjustment portion 220 with respect to the recessed portion 320 to prevent left-and-right movement and to adjust a front-and-rear step difference. The stopper body 310 and the fixing portion 330 may prevent front-and-rear movement of the stopper 330 and mitigate collision between the door 12 and the cabinet 11.

Figure 11:
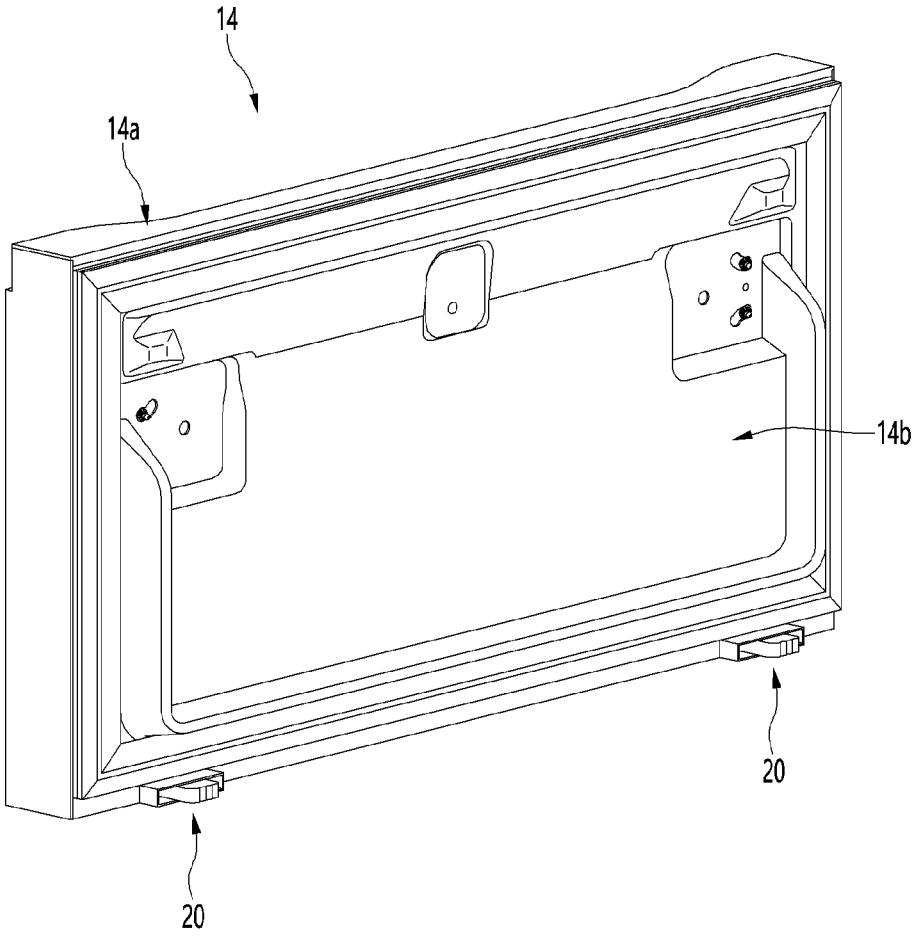
FIG. 11 is a perspective view of a door according to another embodiment of the present disclosure.

FIG. 11 is a perspective view of a door according to another embodiment of the present disclosure.

As shown in FIG. 11, even in the case of a sliding door such as the second door 14 or the third door 15, step difference adjustment members 20 may be provided on the rear surface of a lower frame like the first door 13.

Specifically, the second door 14 includes a frame 14*a* forming an outer surface, a door liner 14*b* is provided on a rear surface of the frame 14*a*, and the step difference adjustment members 20 are disposed on a lower side of the frame 14*a*.

The step difference adjustment members 20 may be spaced apart from each other and disposed close to the side surface of the frame 14*a* to adjust a front-and-rear step difference through sliding in the same manner as the step different adjustment member 20.

According to the refrigerator according to the embodiment of the present disclosure, a front-and-rear step difference between doors can be adjusted through simple operation of a step difference adjustment member provided on a rear surface of the door and thus a user can easily solve the front-and-rear step difference between the doors which may occur while using the refrigerator.

In addition, since a front-and-rear step difference which may occur due to dimensional tolerance between parts at the time of initial shipment of a refrigerator can be easily adjusted, manufacture can be easy.

In addition, since the step difference adjustment member is formed of an elastically deformable material, it is possible to absorb shock and prevent noise from being generated when the door is closed.

In addition, as the step difference adjustment member is provided, it is possible to adjust a front-and-rear step difference between doors and to ensure thermal insulation of the doors.

What is claimed is:

1. A refrigerator comprising:

a cabinet defining a storage space;

a door configured to open and close the storage space; and a step difference adjustment member disposed at a rear surface of the door, wherein the step difference adjustment member comprises (i) a stopper that contacts, based on the door being closed, a front surface of the cabinet and (ii) a mounting portion that defines an accommodation space into which the stopper is inserted, wherein the stopper is configured to move with respect to the mounting portion to thereby vary a protruding length of the stopper from the mounting portion, wherein the mounting portion defines an opening and has different depths recessed from the opening in a left and right direction, and wherein the different depths correspond to different lengths of the stopper protruding from the door.

2. The refrigerator of claim 1, wherein the opening faces toward the rear surface of the door, and wherein the accommodation space into which the stopper inserted is recessed from the opening of the mounting portion.

3. The refrigerator of claim 1, wherein the mounting portion comprises an inclined portion that defines the accommodation space and that is inclined with respect to the opening.

4. The refrigerator of claim 1, wherein the mounting portion comprises a pair of parallel side surfaces, and wherein a length of a first side surface of the pair of parallel side surfaces is greater than a length of a second side surface of the pair of parallel side surfaces.

5. The refrigerator of claim 4, wherein the mounting portion comprises a plurality of protrusion ends that protrude from the pair of parallel side surfaces and toward each other.

6. The refrigerator of claim 5, wherein the stopper is configured to move between the protrusion ends to thereby vary a length of a portion of the stopper protruding from the rear surface of the door.

7. The refrigerator of claim 1, wherein the mounting portion comprises:

a seating surface on which the stopper is mounted, and a plurality of projections protruding from the seating surface.

8. The refrigerator of claim 7, wherein the stopper is located between two adjacent projections among the plurality of projections.

9. The refrigerator of claim 7, wherein the stopper comprises (i) a stopper body having an uneven surface that contacts the cabinet and (ii) recessed portions recessed inward from side surfaces of the stopper body.

10. The refrigerator of claim 9, wherein the recessed portions are located between two adjacent projections among the plurality of projections.

11. The refrigerator of claim 9, wherein a height of a protrusion of the plurality of projections is less than a height of the stopper body.

12. The refrigerator of claim 7, wherein a distance from the rear surface of the door to each of the plurality of projections is different from each other.

13. The refrigerator of claim 1, wherein the mounting portion protrudes backward from the rear surface of the door.

14. The refrigerator of claim 1, wherein the stopper is made of an elastically deformable material.

15. The refrigerator of claim 1, wherein the door includes:

a frame assembly defining an external surface of the door, a door liner defining a rear surface of the frame assembly, and a gasket that seals the frame assembly and the door liner.

16. The refrigerator of claim 15, wherein the frame assembly includes:

an upper frame defining an upper surface of the frame assembly, a lower frame defining a lower surface of the frame assembly, and a side frame connecting the upper frame to the lower frame.

17. The refrigerator of claim 16, wherein the step difference adjustment member is disposed at the lower frame of the frame assembly.

18. The refrigerator of claim 16, wherein the lower frame includes (i) a vertical frame that defines a front surface of the frame assembly and that is coupled to a front panel of the door and (ii) a horizontal frame that is angled from the vertical frame and that defines a lower surface of the door.

19. The refrigerator of claim 18, wherein a rear surface of the lower frame is spaced apart from the vertical frame, and wherein the step difference adjustment member is disposed at the rear surface of the lower frame.

* * * * *